United States Patent [19]

Fermer et al.

[11] 3,984,194

[45] Oct. 5, 1976

[54] AXIAL FLOW FANS

[75] Inventors: Karl-Erik F. Fermer, Jonkoping; Dennis I. Svensson, Vaggeryd, both of Sweden

[73] Assignee: Aktiebolaget Svenska Flaktfabriken, Stockholm, Sweden

[22] Filed: Apr. 12, 1974

[21] Appl. No.: 460,524

[52] U.S. Cl. ..... 416/135; 416/167; 416/207

[51] Int. Cl.[2] ..... F04D 29/36

[58] Field of Search ..... 416/131, 138, 135, 164, 416/167, 206, 207, 141

[56] References Cited

UNITED STATES PATENTS

| | | | |
|---|---|---|---|
| 1,802,648 | 4/1931 | Heath | 416/205 |
| 1,927,592 | 9/1933 | Lambert | 416/147 |
| 2,344,266 | 3/1944 | Reissner | 416/141 X |
| 2,844,303 | 7/1958 | Kristiansen | 416/167 |
| 3,324,953 | 6/1967 | Greenhill | 416/207 X |
| 3,452,820 | 7/1969 | Philipsen et al. | 416/207 X |
| 3,545,884 | 12/1970 | Schroeter et al. | 416/207 X |
| 3,860,361 | 1/1975 | McMurtry et al. | 416/131 X |

FOREIGN PATENTS OR APPLICATIONS

| | | | |
|---|---|---|---|
| 523,917 | 8/1921 | France | 416/135 |
| 944,761 | 4/1949 | France | 416/207 |
| 1,283,852 | 11/1968 | Germany | 416/207 |
| 713,187 | 11/1941 | Germany | 416/135 |
| 826,519 | 1/1960 | United Kingdom | 416/207 |
| 903,792 | 8/1962 | United Kingdom | 416/207 |
| 606,151 | 8/1948 | United Kingdom | 416/500 |

*Primary Examiner*—Everette A. Powell, Jr.
*Attorney, Agent, or Firm*—Cushman, Darby & Cushman

[57] ABSTRACT

In an axial flow fan impeller, the natural frequency of vibration of the individual blades is increased by mounting each blade to the annular support rim or hub for swinging movement relative to the ring about an axis, which lies generally perpendicular to a radius passing through the mounting. For a given blade, the mounting enables the fan to be rotated at higher speeds with a corresponding increase in performance. The mounting also permits the use of thinner, lighter-weight blades for a given operating speed and this permits a reduction in the cross sectional area of the rim. If the impeller includes a mechanism for controlling the pitch of all the blades during operation, the use of lighter-weight blades reduces the stresses on the mechanism so that the design and strength of the latter does not tend to be a limiting factor on the maximum permissible speed for the impeller.

12 Claims, 13 Drawing Figures

Fig. A.
(PRIOR ART)

Fig. C.
(PRIOR ART)

Fig. 2.
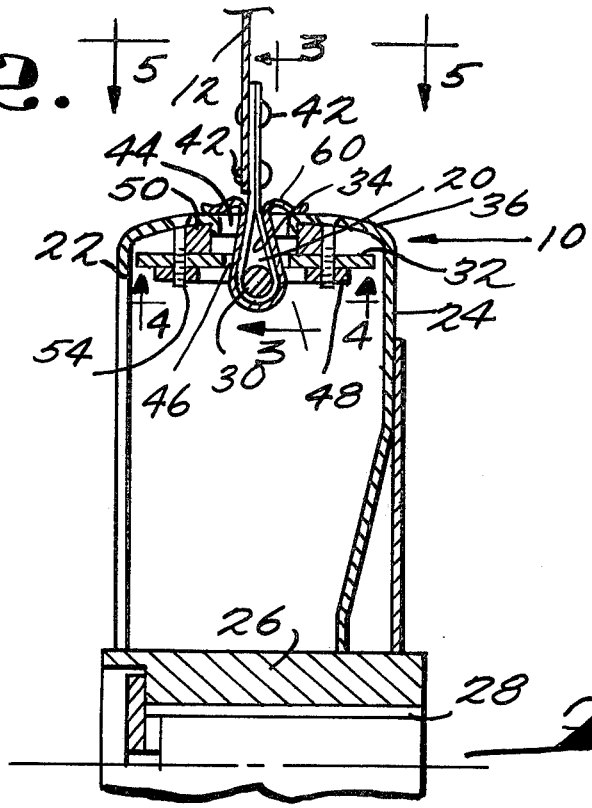
Fig. 4.
Fig. 3.
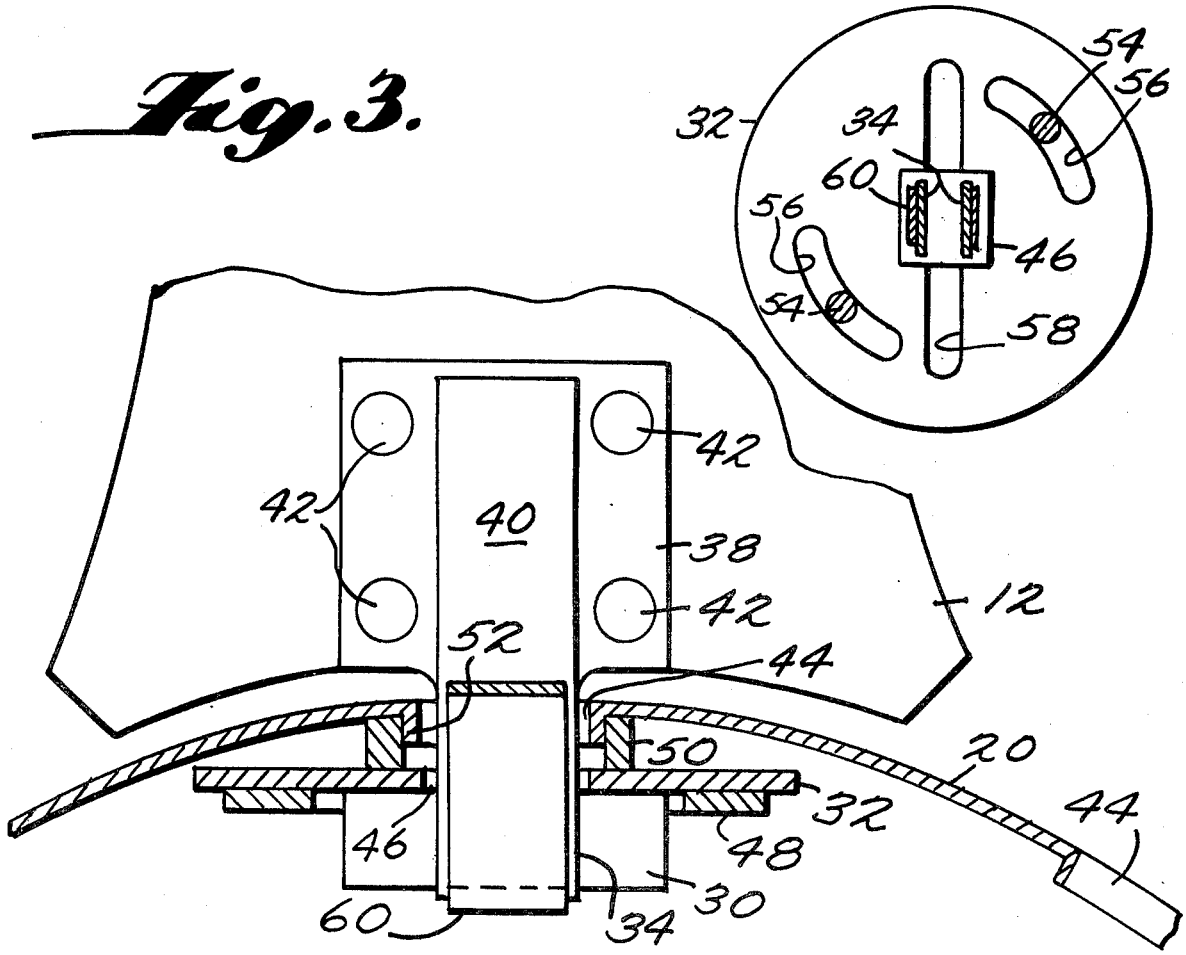

Fig. 7.
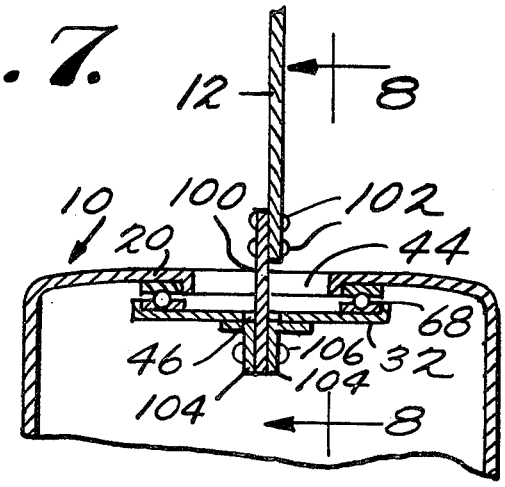
Fig. 8.
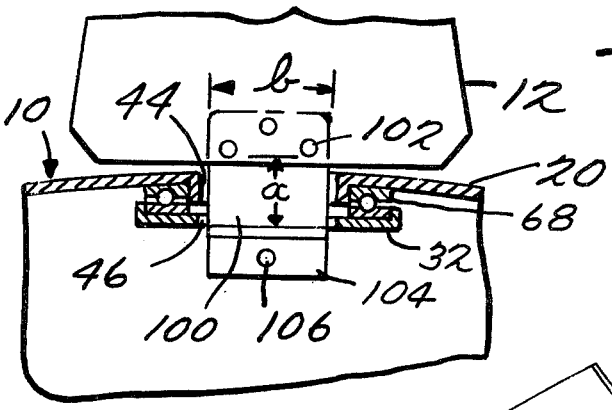
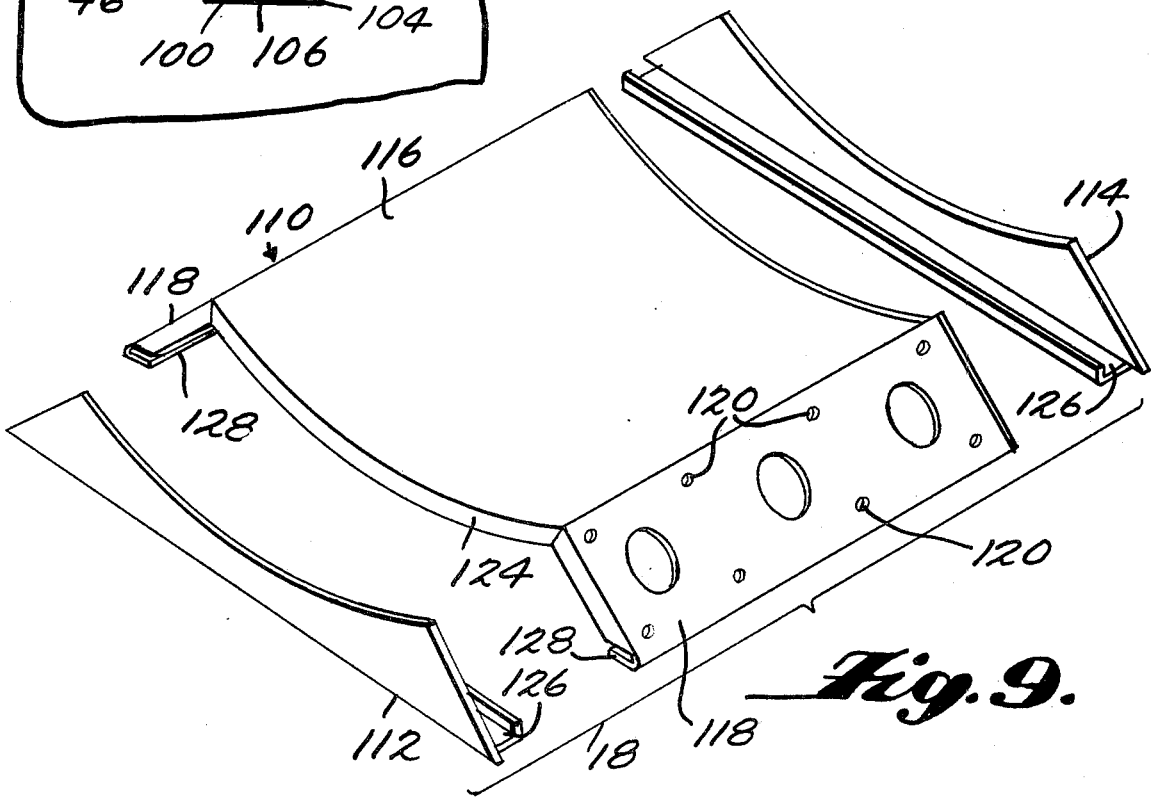
Fig. 9.

AXIAL FLOW FANS

This invention relates to axial flow fans and in particular to impeller constructions which are capable of high performance and which permit the use of lightweight blades.

BACKGROUND AND GENERAL DESCRIPTION

The principal components of the impeller of an axial flow fan are a support rim or hub, which is rotated about its axis by a motor, and a plurality of blades projecting radially from and carried by the rim. In addition, in some impeller constructions the connection between the inner ends of the blades and the rim permits the pitch of all the blades to be adjusted simultaneously during rotation. It is recognized in the manufacture of impellers that the weight of the blades and of the rim and of the pitch-controlling mechanism when present should be as low as the performance requirements of the fan will permit. For this reason it would be desirable to make the blades of thin material, such as sheet metal, and this can be done when the fan is of relatively small size and need produce only a relatively small pressure increase and a correspondingly small air flow. However, thin blades have not been successful in the past in large high performance fans, due to the inherent problems which a thin blade introduces. As a result, high performance axial flow fan impellers are conventionally fitted with rather thick, heavy blades which are usually cast from metal. These heavy blades in turn require a relatively massive rim to withstand the stresses produced by centrifugal force during running. Further, in fans having blades which can be adjusted during running, the high centrifugal forces resulting from the use of heavy blades place high stresses on the mechanism used for controlling the pitch of the blades.

Considering more in detail the conventional parameters employed in designing an axial flow impeller, it is known that an impeller blade should have a high natural frequency of vibration, i.e. the inherent flexing of the blade about its fixed inner end should take place at high frequency. Since an increase in the thickness of a given blade increases the natural frequency of the blade, one of the first steps in designing an impeller is to determine the minimum thickness required to produce a blade having the necessary high natural frequency. For large fans capable of producing substantial pressure increases and substantial air flows, the minimum blade thickness is relatively large. This, then, is the principal reason for the previously stated requirement to use thick blades. It follows that the thick blades are heavier and that the heavier blades produce greater centrifugal forces on the rim, thereby requiring a rim of greater thickness in the radial direction.

Since the centrifugal force produced by a blade on the rim is many times, for example 1000 times, the weight of the blade, it is evident that if the thickness of the blades can be reduced, several important advantages result, in terms of reduced material and manufacturing costs, reduced fan weight and generally simpler design.

It is also recognized in the art that for a given blade construction, the natural frequency of vibration for that blade places a restraint on the maximum permissible speed for the impeller. It is evident, therefore, that if the natural frequency of the given blades can be increased, the fan can be run at higher speed with a corresponding increase in performance.

The present invention is based on the discovery that the natural frequency of vibration of an axial flow fan blade can be increased by attaching the blade to its rim or hub by a low-friction pivot-like connection which allows swinging movement of the blade relative to the rim. It is now possible, therefore, to reduce the thickness and therefore the weight of the blades, and to restore the resulting reduction in natural frequency by using the pivotal connection. This makes it possible to construct the blades from, for example, sheet metal which can be economically stamped into the desired blade configuration. A reduced blade weight significantly reduces the centrifugal forces on the rim, as discussed above, and therefore the present invention permits the rim to be constructed with a thinner cross section. This not only reduces the weight of the rim, but allows the use of less costly manufacturing techniques.

If the impeller is of the type having controllable-pitch blades, the use of lighter-weight blades reduces the stresses on the control mechanism particularly on the blade thrust bearings. The bearing associated with each blade permits that blade to be turned when the fan is running and must of necessity be constructed to withstand the high stress produced by centrifugal force acting on the blade. The strength of the bearings is often a restraint on the maximum permissible speed of the impeller in a conventional design, but the use of lighter blades, as achieved by the present invention, reduces the stress on the bearings and thereby removes this restraint on speed.

The invention is not, however, limited to impeller constructions in which the blades are of lighter construction than would conventionally be employed. For any given impeller the inclusion of the pivot-like connection between the blade and the rim increases the natural frequency of the blade, and this increases the maximum permissible operating speed of the impeller.

The swinging movement permitted by the pivot-like connection is such that the blade can swing about an axis which is located at the inner end of the blade in a plane perpendicular to a rim radius passing through the connection. In order not to introduce bending forces on the blade, this radius should preferably also pass through the center of gravity of substantially all sections of the blade. The disposition of the axis in the indicated plane is preferably parallel to the average chord of the blade, i.e. a chord which is the average of all chords drawn along the blade from one end to the other, but it may vary considerably from this position. The amount of increased natural frequency of the blade produced by the swinging connection decreases as the angle of the swing axis departs from parallelism with the average blade chord, until essentially no advantage exists when the swing axis is perpendicular to the average blade chord. For most applications the axis should lie within a 40° range in either direction from the average blade chord.

The pivot-like connection may be provided by a variety of different structures several of which are illustrated in the drawings. It is important that the connection avoid pivot structures in which there is sliding contact between parts, as in a conventional hinge, because the friction which friction would develop as a result of centrifugal force on the blade would prevent the free swinging movement required by the present invention.

In its broadest form, the connection may include a universal joint having one end secured to the rim and the opposite end secured to the inner end of the blade, the joint being restrained against turning movement in a pitch-adjusting mode. Alternatively, the connection may be provided by a thin high tensile strength spring type metal band connected between the rim and the inner end of the blade. In a preferred construction, the inner end of the blade carries a pin extending in a plane perpendicular to the axis of the blade. The surface of the pin which faces outwardly toward the blade makes line contact with a surface of a restraining element carried by the rim. The pin can therefore roll against the plate to a limited extent, and as it does so the blade swings. Centrifugal force on the blade forces the pin tightly against the surface, but this does not affect the freedom of the pin to roll and to thereby achieve the desired increase in the natural frequency of the blade. A few degrees of swinging is sufficient, but this small movement must be an unrestrained as possible.

DETAILED DESCRIPTION

The invention will be further understood from the following more detailed description taken with the drawings in which:

FIGS. A, B, C and D are schematic views of axial flow fan blades illustrating the basic principles of the invention;

FIG. 2 is a sectional view of the rim of FIG. 1, showing the mounting of one of the blades and omitting the other mountings;

Figure 5:
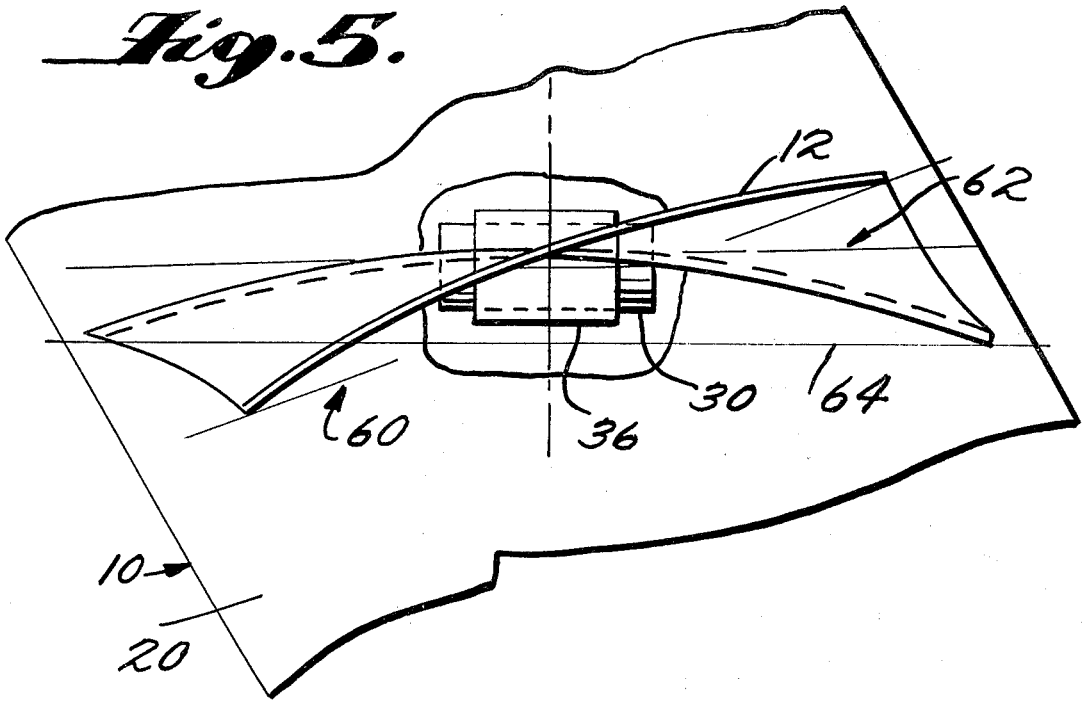
Figure 6:
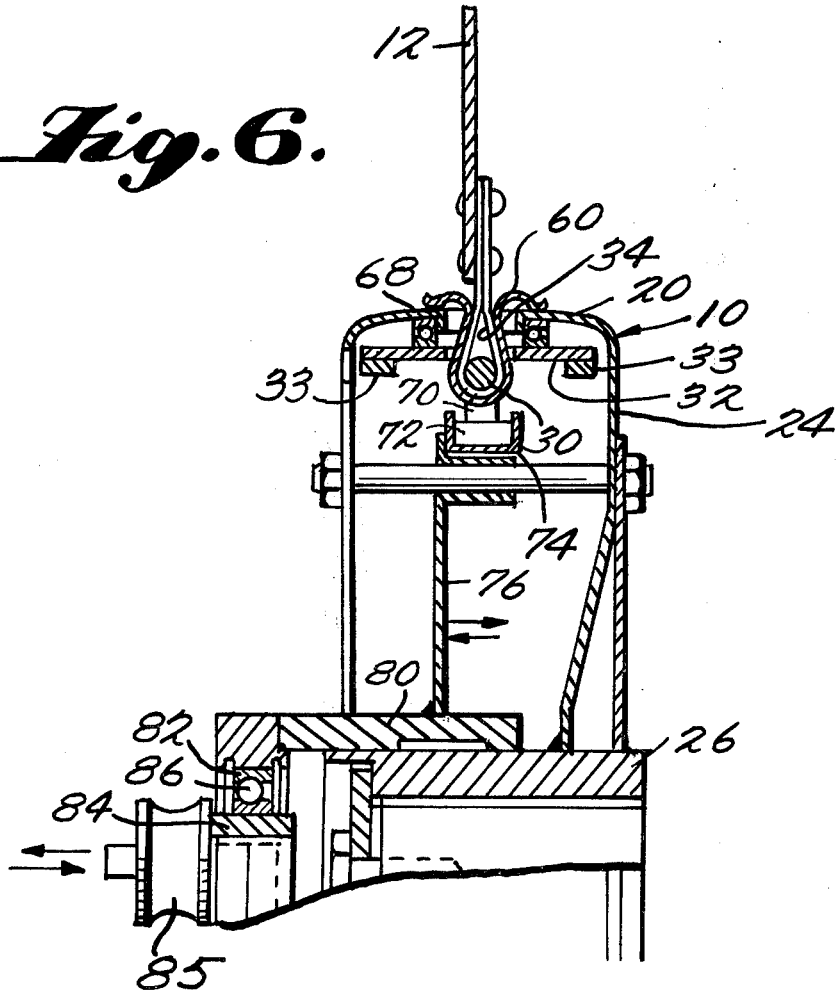

FIGS. 3 and 4 are sectional views taken on the lines 3—3 and 4—4, respectively, of FIG. 2;

FIG. 5 is an end view of a blade taken generally on the line 5—5 of FIG. 2;

FIG. 6 is a sectional of a rim, similar to FIG. 2, and illustrating a blade mounting which includes a pitch control mechanism;

FIG. 7 is a sectional view of a rim illustrating a different form of blade mounting;

FIG. 8 is a view taken on the line 8—8 of FIG. 7; and

Figure 1:
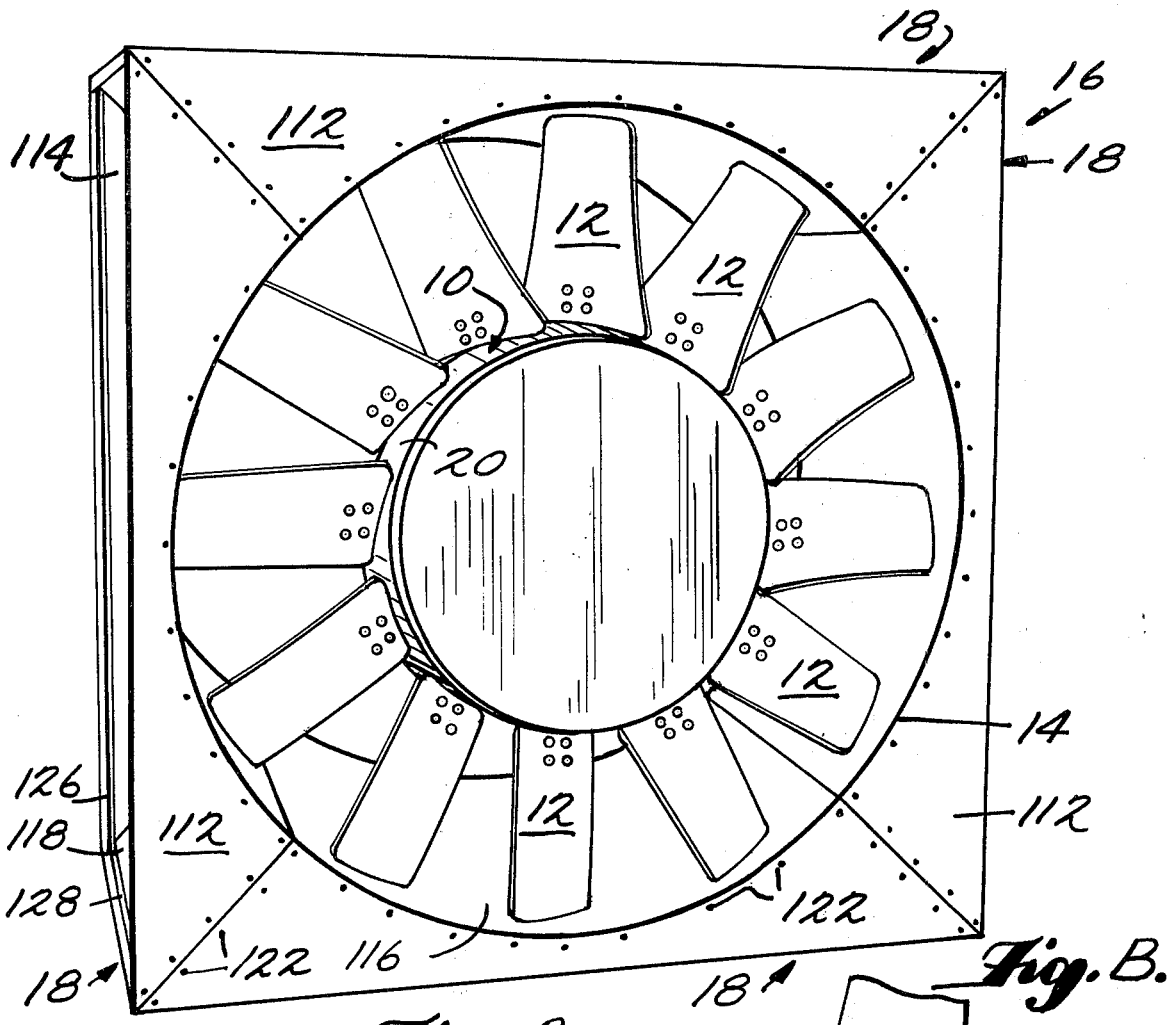
FIG. 1 is rear perspective view of an axial flow fan assembly illustrating the positions of the rim and blades relative to a casing, with parts inside the rim being omitted.
Figure 1:
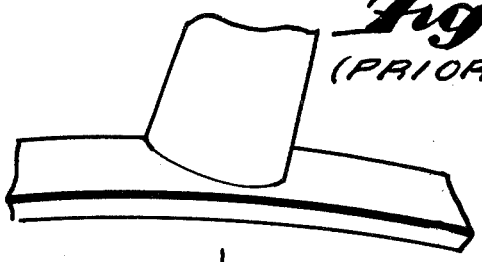
Figure 1:
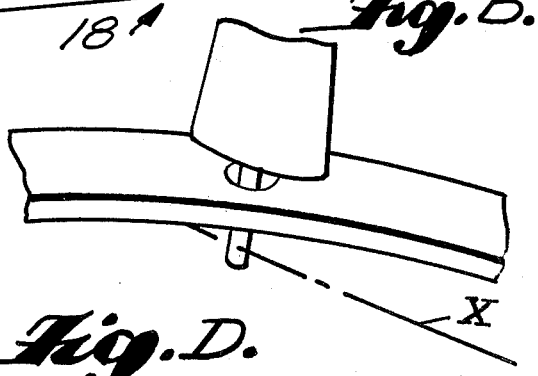
Figure 1:
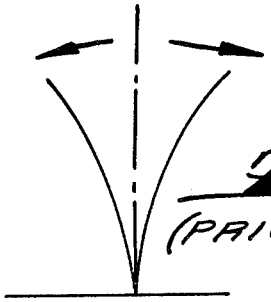
Figure 1:
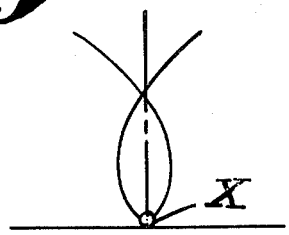

FIG. 9 is an exploded view of a section of the casing of FIG. 1.

Referring to FIG. A, a typical conventional blade is shown as it may be used in existing fan designs. The root is rigidly attached to the rim. FIG. B shows a blade according to the subject invention, mounted to the rim in a manner permitting a swinging movement of the blade relative to the rim about an axis X. If subjected to a disturbance, the conventional blade as shown in FIG. A will flex as illustrated symbolically in FIG. C. The blade shown in FIG. B will flex as shown in FIG. D. That is, the pivotal attachment of the blade in FIG. B permits the attached end of the blade to swing as illustrated in FIG. D. As is known in dynamics, for a given plate the natural frequency of the plate is increased approximately 4 to 5 times if the plate is mounted so that its attached end is free to swing. Thus, by using this type of mounting for a fan blade, as shown in FIGS. B and D, the present invention increases the natural frequency of the blade, thereby providing the advantages described above.

Referring to FIG. 1, there is shown an axial flow fan assembly having an impeller which includes a hub or rim 10 carrying a plurality of outwardly projecting blades 12. The rim 10 is mounted caoxially within a cylindrical passage 14 through a casing 16 by means of suitable support structure (not shown) and is rotatably driven about its axis by means of a motor (not shown) supported coaxially with the rim 10. The blades 12 are constructed of sheet metal stamped to the desired contour and are mounted on the rim 10 by pivot-like connections (not visible in FIG. 1) located inside the rim 10. The casing 16 is constructed of four identical sections 18, each of which is made of an assembly of stamped sheet metal parts.

The construction of the rim 10 and pivot-like connection between the rim 10 and each blade 12 of FIG. 1 is shown in FIGS. 2, 3 and 4. The rim 10 is made of a single piece of metal pressed to the desired configuration which in this embodiment includes a peripheral wall 20 integral with a turned in strengthening flange 22 and with an end wall 24. The end wall 24 is provided with a central aperture into which a driving hub 26 is welded. In a complete assembly the driving hub 26 receives a motor shaft to which it is secured, as by means of a key inserted into a keyway 28.

The essence of the pivot-like connection between a blade 12 and the rim 10 in this embodiment of the invention is a hard metal pin 30 carried by the inner end of the blade 12 in rolling engagement with a hard rigid plate 32 which is secured to the rim 10 at a location inside the peripheral wall 20. As shown in FIGS. 1 and 4, the inner end of the blade 12 carries a metal strap 34 which projects from the blade 12 generally along the longitudinal axis of the blade 12. The strap 34 is formed from a single strip of metal folded end-to-end to provide a loop 36 at one end, the folded end portions then being welded to each other. One end portion 38 of the strip is wider than the other end portion 40, and the wider portion 38 is secured to the inner end of the blade 12 by four rivets 42.

The strap 34 extends through a radially facing hole 44 in the rim and through a hole 46 in the plate 32 so as to dispose the loop 36 adjacent to the inner face of the plate 32. The pin 30 passes loosely through the loop 36 and is retained in this position by a ring 48. The plate 32 is spaced from the rim wall 20 by a collar 50 which surrounds an inwardly projecting flange 52 at the location of the hole 44 in the rim. The plate 32 is therefore in a plane perpendicular to a rim radius passing through the center of the hole 44. The plate 32 is clamped in position by two screws 54 which pass through arcuate slots 56 in the plate and into threaded engagement with the ring 48. The pitch of the blade 12 may be changed by loosening the screws 54, rotating the plate 32 and then tightening the screws 54.

The pin 30 rolls in a groove 58, which is of larger diameter than the pin so as to establish line contact and avoid sliding movement between the plate 32 and the pin 30. The presence of the groove is not critical, since the pin 30 can roll against a flat surface on the plate 32, if desired. Also, the pin can be replaced with some other element capable of engaging the plate 32 with line contact. For example, a wedge having a small radius of curvature at its apex may be employed.

In order to hold the blade 12 in a generally radial position when the fan is not operating, a spring clip 60 centers the blade 12 in the hole 44 in the rim 12. The clip 60 is generally U-shaped so as to fit over the loop portion 36 of the strap 34. The free ends of the clip are bent back toward the rim 10 and engage the outer surface of the rim wall 20. As soon as the fan is started, the centrifugal force on the blade tends to pull it outwardly and this tightly engages the pin 30 with the plate 32. There is, however, very little resistance to rolling action between the pin 30 and the plate 32 due to the line contact between the two even at high fan speed. The anti-friction pivot connection is therefore always operable, and this is necessary if the connection is to perform its required function of increasing the natural frequency of vibration of the blade 12. The connection also permits the blade 12 to swing to and remain in a position dictated by the interaction of centrifugal forces and aerodynamic forces on the blade 12.

The contour of the blade 12 may be conventional. As seen in FIG. 5, the blade is straight in a radial direction and is arcuately curved from its leading edge to its trailing edge. The inner and outer ends are angularly offset as is conventional. In the illustrated embodiment, the axis 62 of the pin 30 is parallel to the chord 64 at the inner end of the blade 12, but it may vary considerably from this position. A position parallel to the average chord of the blade 12 is optimum, the average chord being defined as the average of an infinite number of chords drawn between leading and trailing edges of the blade 12. The chord at the outer end of the blade 12 is shown at 66. The direction of the pin axis 62 may vary as much as about 40° from the average chord, in either direction.

FIG. 6 illustrates an embodiment in which the pitch of the blades 12 can be controlled during operation of the fan. The construction and operation of the rim 10, blade 12, pin 30, plate 32 and strap 34 are the same as in FIG. 2. In this embodiment the plate 32 carries counter weights 33 which are used to counteract the natural tendency of the blade to turn under the action of centrifugal force. The plate 32 is mounted on the inner surface of the rim wall 20 by a bearing 68 which permits rotation of the plate 32 about its axis. The angular disposition of the plate 32 in its own plane is controlled by an assembly which includes a pin 70 having its outer end fixed to the plate 32 near the outer edge thereof, so that movement of pin 70 in a plane parallel to the plane of the plate 32 causes the plate 32 to rotate. The inner end of the pin carries a bearing 72 which resides in a channel-shaped circular ring 74 disposed coaxially within the rim 10. Accordingly, if the ring 74 is moved along the axis of the rim 10, the resulting movement of the pin 70 will rotate the plate 32 and the blade 12. The relative turning and sliding movement between the inner end of the pin 70 and the ring 74 during movement of the latter is accommodated by the bearing 72. The ring 74 is fixed to the peripheral portion of an annular disc 76 which is disposed coaxially with the rim hub 26. One or more studs 78 pass through the disc 76 and through the end wall 24 of the rim 10 so that the disc 76 rotates with the rim 10. A control sleeve 80 surrounding the hub 26 is fixed to the disc 76 and therefore rotates with the rim 10. The control sleeve 80 is also slidable relative to the hub 26 in order to move the ring 74 back and forth along the axis of the rim 10. The outer race of a ball bearing 82 is carried by the control sleeve 80, and the inner race is carried by a non-rotating element 84 employed to move the sleeve 80 linearly relative to the hub 26. The balls 86 of the bearing 82 serve as thrust bearings when a force is applied to the non-rotating element 84 in the direction of either of the arrows shown in the figure. Since the non-rotating element 84 can move only along the axis of the bearing 82, it is convenient to apply the force to the element 84 through a rubber connecting element 85, which serves as a low-cost universal joint.

FIGS. 7 and 8 illustrate another form of pivot-like connection, the pivoting function of which is also unaffected by centrifugal forces on the blade 12. In this embodiment, the connection is a flat steel spring 100 of high tensile strength attached at its outer end to the inner end of the blade 12 by rivets 102. The inner end of the spring 100 passes through the hole 46 in the plate 32 and is clamped between two flange pieces 104 by means of rivets 106. The flange pieces 104 are welded or otherwise fixed to the inner surface of the plate 32 which is spaced from the wall 20 of the rim 10 by the bearing 68. The spring 100 is inherently resistant to twisting motion, but to assure that the pitch of the blade 12 will not change relative to the plate 32, the width (*b*) of the spring 100 should be substantially greater than the distance (*a*) between the points of attachment of the spring 100 to the blade 12 and to the plate 32. As a result of the capability of the spring 100 to flex, the outer end of the spring 100, and hence the entire blade 12, is free to swing about an axis lying in a plane which is perpendicular to a rim radius through the spring.

FIG. 9 is an exploded view of one of the casing sections 18. As shown, the section 18 consists of a center piece 110 and two end pieces 112 and 114. The center piece 110 includes an arcuate portion 116 and two leg portions 118, each of which is attached to the arcuate portion 116 so as to lie on a radius of the curvature of the arcuate portion 116. In the assembled casing 16 of FIG. 1, the four arcuate portions 116 of the four casing sections form the passage 14, and each leg portion 118 abuts the leg portion 118 of the adjacent section 18. The sections 18 are secured together by screws passing through each pair of abutting leg portions 118, at locations illustrated at 120 in FIG. 9.

The end pieces 112 and 114 of each casing section 18 are attached to the respective center piece 110 by means of screws 122 (FIG. 1) which pass through the end pieces 112 and 114 and through flanges 124 provided on the ends of the center piece 110. The rigidity of each end piece 112 and 114 is improved by a strengthening flange 126, the rigidity of each leg portion 118 is improved by a strengthening flange 128.

Since modifications may be made to the illustrative embodiments described above without departing from the principles of the invention, it is not intended that the invention be limited to the details of the illustrated embodiments except as these details may appear in the appended claims.

What is claimed is:

1. An axial flow fan comprising: a hub for receiving rotary drive power; a hollow cylindrical rim coaxial with and surrounding said hub and spaced radially therefrom; means securing said rim to said hub; a plurality of radially disposed fan blades disposed in a common plane the assembly of hub, rim and blades being mounted coaxially in a cylindrical passage extending through a casing; each blade having an inner end portion passing through an aperture in said rim, each aperture having associated therewith an annular blade-mounting plate disposed concentrically with the respective aperture at a location between said hub and the inner surface of the rim; means connecting the inner end of each blade to its respective plate, said means including a pivot member having a curved surface in rolling line contact with the inner surface of said plate and a loop element which defines the inner end of the respective blade, said loop element surrounding said pivot member and extending through said annular plate.

2. An axial flow fan as in claim 1 including a generally U-shaped spring clip fitting over said loop element, said clip having free ends extending through said annular plate and through the respective aperture in the rim, said free ends being bent back toward the rim to engage the outer surface, whereby said clip holds the respective blade in a generally radial position when said rim is not rotating.

3. An axial flow fan as in claim 1 including an annular clamping ring engaged with the inner surface of said annular plate and at least two releasable fastening means passing through the rim and through arcuate slots in said plate into threaded engagement with said clamping ring, whereby the angular position of said plate relative to the axis of the aperture may be adjusted.

4. An axial fan as in claim 1 including an annular bearing assembly disposed between the outer surface of said annular plate and the inner surface of said rim and including means for rotating said plate in an arc about the axis of the respective aperture, said means including a sleeve concentrically on said hub for rotation therewith and for sliding movement relative thereto in axial directions and means located inside said rim for converting axial movement of said sleeve to arcuate movement of said plate.

5. In an axial flow fan: a hollow cylindrical hub for receiving a drive shaft; a rim having a peripheral wall concentric with and radially spaced from the hub, an integral annular flange projecting toward the hub and an integral end wall disposed in a plane perpendicular to the axis of the hub and fixed to the hub, said peripheral wall, end wall and annular flange being pressed from a single piece of metal, said peripheral wall having a plurality of radially facing apertures spaced apart along its circumference, the wall of each of said apertures forming an annular flange projecting inwardly toward the axis of the hub; a plurality of radially disposed fan blades, each having an inner end protruding outwardly through one of the apertures in the peripheral wall of the rim from a location radially inward of the respective peripheral flange; a plate disposed radially inwardly of each aperture in the peripheral wall of the rim in a plane perpendicular to a rim radius passing through the respective aperture, said plate having an aperture concentric with the respective rim aperture, the inner end of the respective fan blade passing through the plate aperture and being connected to the surface thereof facing the hub by a pivot-like connection for permitting swinging movement of the blade relative to the rim generally about an axis which is disposed in a plane perpendicular to a rim radius passing through the connection; means connecting said plate to the inner surface of the peripheral wall of the rim; and means for adjusting the angular position of the plate with respect to the axis of the respective aperture in the peripheral wall of the rim.

6. An axial flow fan as in claim 5 wherein said plate is provided with at least two arcuate slots which are concentric with the axis of the respective aperture in the peripheral wall of the rim and wherein said means for adjusting the angular position of the plate includes screws disposed in holes in said peripheral wall and passing through said slots into threaded engagement with a common retaining element.

7. An axial flow fan as in claim 5 wherein the means connecting said plate to the inner surface of the peripheral wall of the rim includes an annular bearing surrounding the respective aperture in said peripheral wall and wherein said means for adjusting the angular position of said plate includes a pin extending inwardly from said plate at a location offset from the axis of the respective aperture in the peripheral wall of the rim and means for moving said pin in a direction parallel to the axis of the rim, said means including a sleeve mounted on said hub for rotation therewith and for axial sliding movement relative thereto and means interconnecting said sleeve with said pin so that axial movement of said sleeve produces arcuate movement of said pin and said plate about the axis of the respective aperture.

8. An axial flow fan as in claim 5 wherein the inner end of each fan blade forms a loop disposed between the hub and the respective plate, and wherein said pivot-like connection includes a pin lying within the loop and being in rolling line contact with the adjacent surface of the respective plate.

9. In an axial flow fan: a hollow cylindrical rim having a plurality of radially facing apertures spaced apart along its circumference; a plurality of radially disposed fan blades, each having an inner end passing through one of the apertures in the cylindrical wall of the rim from a location radially inward thereof, said inner end being in the form of a loop; a plate disposed radially inwardly of each aperture in the cylindrical wall of the rim in a plane perpendicular to a rim radius passing through the respective aperture, said plate having an aperture concentric with the respective rim aperture, the inner end of the respective fan blade passing through the plate aperture and being connected to the surface thereof facing the hub by a pivot-like connection for permitting swinging movement of the blade relative to the rim generally about an axis which is disposed in a plane perpendicular to a rim radius passing through the connection, said pivot-like connection including a pin in rolling line contact with said surface of the plate and lying within the loop formed by the inner end of the respective fan blade; and a generally U-shaped spring clip fitting over said loop and having free ends extending through the aperture in the plate, said free ends being bent back toward the cylindrical rim wall and engaging the same, and means connecting said plate to the inner surface of the cylindrical wall of the rim.

10. An axial flow fan as in claim 9 wherein the periphery of each aperture in the cylindrical rim wall is formed by an annular flange which is integral with the rim wall and which projects radially inward with respect to the rim wall, and wherein the means connecting each plate to the rim wall includes an annular member surrounding and engaging the respective annular flange and spacing the plate from the rim wall.

11. An axial flow fan as in claim 10 wherein said annular member includes a bearing permitting angular adjustment of the plate with respect to the axis of the respective aperture in the rim wall.

12. An axial flow fan as in claim 10 wherein the plate is provided with at least two arcuate slots which are concentric with the axis of the aperture in the rim wall, and further including screws disposed in holes in the rim wall and passing through the slots into threaded engagement with a common retaining means.

* * * * *